US006319141B1

(12) United States Patent
Cartee

(10) Patent No.: US 6,319,141 B1
(45) Date of Patent: Nov. 20, 2001

(54) VARIABLE POINT POOL TABLE AND ASSOCIATED GAME

(76) Inventor: James Ronald Cartee, 143 W. Airline Hwy. Lot 15, Kenner, LA (US) 70062

( * ) Notice: Subject to any disclaimer, the term of this patent is extended or adjusted under 35 U.S.C. 154(b) by 0 days.

(21) Appl. No.: 08/504,345

(22) Filed: Jul. 19, 1995

(51) Int. Cl.[7] ..... A63D 15/02
(52) U.S. Cl. ..... 473/20
(58) Field of Search ..... 473/20

(56) References Cited

U.S. PATENT DOCUMENTS

D. 83,747 * 3/1931 Pavelka ..... 473/20
289,217 * 11/1883 Calder ..... 473/20
4,183,525 * 1/1980 Marco ..... 473/20

FOREIGN PATENT DOCUMENTS

204134 * 9/1920 (CA) ..... 473/20
2167673 * 6/1986 (GB) ..... 473/20
2229370 * 9/1990 (GB) ..... 473/20

* cited by examiner

*Primary Examiner*—Theatrice Brown

(57) ABSTRACT

This invention pertains to a pool table that consists of 16 pockets rather than the normal six pockets but also includes the normal six pockets. Some of the pockets vary in size. Since the balls are rated as a face value in points and the pockets have a face value rated in points. The multiplying of one another produces a score for every single shot. The highest point scorer wins the game. This is why the invention is titled "Variable Point Pool."

2 Claims, 1 Drawing Sheet

Fig. 1
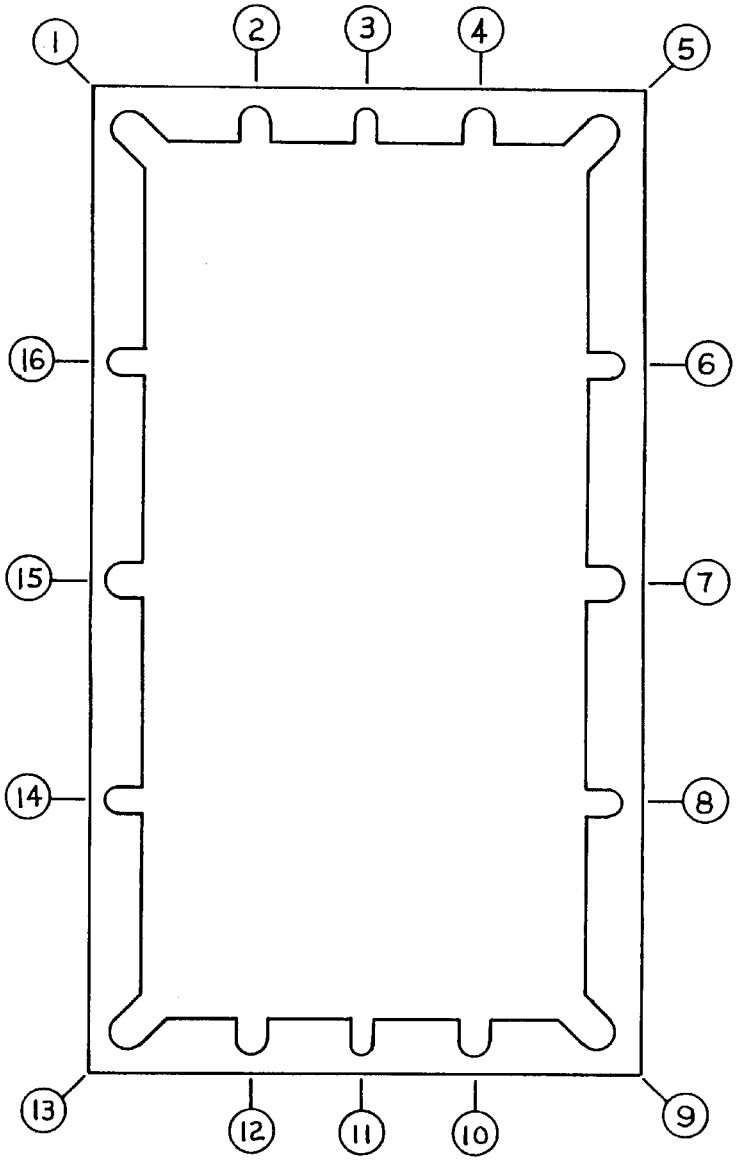
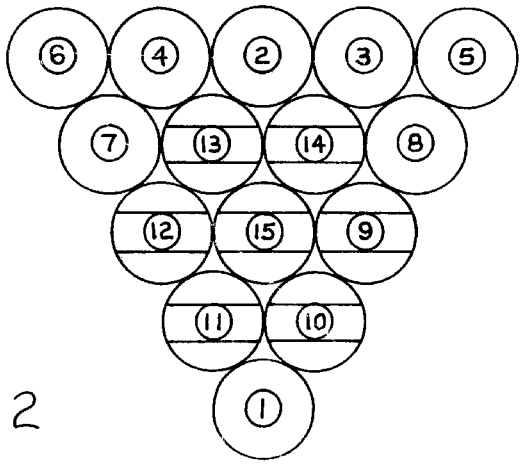
Fig. 2

VARIABLE POINT POOL TABLE AND ASSOCIATED GAME

BACKGROUND OF INVENTION

A. Field of Invention

The Invention relates to a new pool table top consisting of 16 pockets and they are assigned face value points according to size.

B. Description of the Prior Art

Pool tables which have only the normal six pockets and are all of the same width opening and cannot be assigned different face value points as can be in variable point pool.

SUMMARY OF THE INVENTION

This invention pertains to a pool table top that has 16 pockets, some of which vary in width size and are assigned face value points according to size and are used as a multiplier against the face value of the ball pocketed into it.

The object of the game is to score the highest points when all the balls are pocketed and win the game. A further object of the invention is that:

The original six pockets on any size pool table were left intact in their normal location so all the games normally played on a pool table could still be played with or without the use of the ten (10) additional pockets added.

BRIEF DESCRIPTION OF THE DRAWINGS

FIG. one (1): Shows the location of the sixteen pockets on the new type variable point pool table.

FIG. two (2): Shows the recommended rack of balls whereas the largest balls are positioned to have the most difficulty of going in a pocket on the break.

DESCRIPTION OF THE PREFERRED EMBODIMENT

FIG. one (1):

Pockets 1,5,7,9,13, and 15 are 4 inches wide and have a multiplying factor of one (1) times the face value of the balls pocketed in them.

Pockets 2, 4, 10, and 12 are 3½ inches wide and have a multiplying factor of two (2) times the face value of the balls pocketed in them.

Pockets 6, 8, 14, and 16 are 3 inches wide and have a multiplying factor of three (3) times the face value of the balls pocketed in them.

Pockets three (3) and 11 are 2½ inches wide and have a multiplying factor of 4 times the face value of the balls pocketed in them.

Pockets 1, 5, 7, 9, 13, and 15, are located on the table where the normal six (6) pockets on a regular pool table are located.

Pocket three (3) is located center line between pocket 1 and 5.

Pocket 2 is located center line between pockets 1 and 3.

Pocket 4 is located center line between pockets 3 and 5.

Pocket 6 is located center line between pockets 5 and 7.

Pocket 8 is located center line between pockets 7 and 9.

Pocket 11 is located center line between pockets 9 and 13.

Pocket 10 is located center line between pockets 9 and 11.

Pocket 12 is located center line between pockets 11 and 13.

Pocket 14 is located center line between pockets 13 and 15.

Pocket 16 is located center line between pockets 15 and 1.

The rest of the dimensions of variable point pool remain the same as found in prior art.

FIG. two (2):

Shows the preferred placement of the balls in a rack of 15 balls because the largest balls are placed within the rack to have the most difficulty of going in on the break.

What is claimed is:

1. A pool game table apparatus comprising a playing surface said playing surface having a peripheral ball rebound rail and at least sixteen ball receiving pickets, said at least 16 pockets defining a plurality of sets of pockets, each set of said plurality of sets having a predetermined specified location in said playing surface periphery and rails different from the remaining sets of pockets, and the pockets of each set being the same size and having a size different from the pockets of any other set, a set of pool balls, each of said balls having an assigned numbered value distinct from an assigned numbered value of any other ball of the set, such that a score awarded when playing a game is determined by the size of the pocket and the number of the ball received in that pocket.

2. A method of playing a pool game comprising the steps of;

providing a playing surface having a peripheral ball rebound rail;

providing a set of at least sixteen (16) pockets in said playing surface and rails;

dividing said set of at least 26 pockets into a plurality of sets of pockets;

Making each pocket of each set of said plurality of sets to have the same size but have a size different from the size of pockets of any other set of the plurality sets;

providing a plurality of game play balls;

assigning a valve to each ball, said value of each ball being different from the value of any other ball;

playing a game by propelling a ball along said playing surface and into a pocket, whereby a score is determined by the combined value of a ball and the size of the pocket receiving the ball propelled therein.

* * * * *